US005097633A

United States Patent [19]

Branton et al.

[11] Patent Number: 5,097,633

[45] Date of Patent: Mar. 24, 1992

[54] SYSTEM AND METHOD FOR CONTROLLING BLASTING APPARATUS

[76] Inventors: Donald L. Branton, 15341 Deering, Livonia, Mich. 48154; Edward C. Moon, 15150 Chatham, Detroit, Mich. 48223; Henry J. Vartanian, 16535 Rougeway, Livonia, Mich. 48154

[21] Appl. No.: 431,908

[22] Filed: Nov. 6, 1989

[51] Int. Cl.[5] ..... B24B 49/00

[52] U.S. Cl. ..... 51/165.71; 51/410; 51/415; 51/427

[58] Field of Search ..... 51/165.71, 165.74, 410, 51/413, 415, 427, 436, 438

[56] References Cited

U.S. PATENT DOCUMENTS

| | | | |
|---|---|---|---|
| 3,858,358 | 1/1975 | Stachowiak et al. | 51/427 |
| 4,075,789 | 2/1978 | Dremann | 51/436 |
| 4,873,855 | 10/1989 | Thompson | 51/415 |

*Primary Examiner*—M. Rachuba

*Attorney, Agent, or Firm*—Charles W. Chandler

[57] ABSTRACT

Operation of a blasting hose is controlled safely and efficiently by the operator at the nozzle by means of a switch-controlled circuit housed at the nozzle and connected to circuits at the blast pot by means of a three-wire cable arranged to stop operation of the blast pot if a main switch held by the operator is released by the operator. The switch-controlled circuit includes a tone generator to produce tones correlated to changing the mix of blast agent and air, as well as cutting off the supply of either or both.

13 Claims, 7 Drawing Sheets

SYSTEM AND METHOD FOR CONTROLLING BLASTING APPARATUS

BACKGROUND OF THE INVENTION

This invention relates to a system, including both apparatus and method, for controlling the operation of blasting apparatus to improve both the safety and ease of operation. In particular, it relates to a system for allowing the operator to control the apparatus by signals from a source in his grasp at the nozzle end of the hose from which the blast agent emerges under high pressure.

It has long been common practice to provide a switch, referred to as a dead man switch, at the operator's end of a high-pressure blasting hose to turn off the stream of blasting material if the operator releases his grip on the switch. Some dead man switches are fluid switches and are connected back to the pressure-controlling apparatus by fluid lines running alongside the main hose. One of the disadvantages of such switches is that it takes an appreciable length of time for the change in fluid conditions due to release of the switch to reach the valve or valves controlled by that fluid. If the switch is released as a result of some emergency condition, and not simply because the operator decided to stop blasting for any of the normal reasons, the time it takes for the change in fluid conditions to affect closure of the valve or valves can be a time when the high-pressure blasting material streams out of an uncontrolled hose. This is clearly a destructive and dangerous condition.

Other dead man switches are electrical and are connected back to the pressurizing apparatus by wires. Such switches are of the normally-open type and are held closed by the operator during a blasting operation. This allows current from a source to flow out through one wire to the switch and back to the control apparatus through the other wire. Any interruption in the current is perceived instantaneously at the control apparatus and begins to turn off the pressurized stream at once. Thus, the time taken for the stream actually to stop is much less than in the case of fluid-controlled switches.

However, electrical switches are subject to another kind of failure. The wires running along the hose are subject to severe wear due to the rough surfaces over which they are likely to be dragged, and the insulation on the wires sometimes wears off, allowing the wires to be short-circuited together, either by direct contact or by mutual contact with a conducting material. As far as current from the source is concerned, there is no difference between flowing through a dead man switch and flowing through a short circuit. The switch by-passed by a short circuit is cut out of the circuit without the knowledge of the operator or any of the safety personnel.

If the dead man switch were of the normally-closed type that had to be held open by the operator to blast a surface, the fact that wires connected to the switch can be broken by the rough treatment to which they are unavoidably exposed would remove the switch from the circuit with the same dangerous effect as short-circuiting the wires connected to a normally-open switch.

In addition to the types of failure that may affect the dead man switches currently in use, there are other aspects of the operation of blasting apparatus that must be controlled. In a typical blasting set-up, there is a large container of material, called blast agent, to be directed forcefully against a surface that is to be treated, such as for the removal of paint, rust, scale, or other materials. Air is compressed and forced as a high-pressure stream through a channel that usually runs under the container, which is commonly called a blast pot. Attached to the blast pot is a connection that allows the blast agent to enter the channel where it will be entrained by the high-pressure stream. The high-pressure stream, which now includes the blast agent, enters a flexible hose that carries it out to the blast site where it emerges from the nozzle as an abrasive stream that can be directed by the operator to strike any point on the surface to be blasted.

A control valve is normally provided between the point at which the pressurized stream of air enters the channel and the point at which the blast agent enters the stream. This valve is closed to stop the stream in response to release of the dead man switch. In addition, in order to cause the blast agent to flow uniformly into the channel carrying the high pressure stream, the space at the top of the blast pot is pressurized, such as by the same means that pressurizes the stream, so that both the outlet of the pot and the space above the blast agent are at the same pressure. This should allow the blast agent to flow into the stream as if the agent were under no pressure at all, except for the fact that moisture condenses in the pot and causes the blast agent to cake up.

The blast agent is kept as dry as possible prior to being put in the pot, and the moisture that reaches it there comes from the air fed into the top of the pot under high pressure. That air comes from the ambient air and always has some moisture in it. When it emerges from the relatively small pipe by which it reaches the upper part of the pot, it suddenly encounters an area of somewhat lower pressure, and this reduces the temperature of the air. As a result, moisture in it condenses, sometimes to the point of falling as rain inside a blast pot.

In order to remove a choking lump of blast agent at the outlet from the blast pot to the channel carrying the high-pressure stream, the control valve is turned off momentarily so that the only pressure on the blast agent in the pot is at the top, forcing the blast agent down into the channel. Heretofore, it has not been possible for the operator at the remote end of the hose to adjust the control valve, and someone else, such as a safety person has had to do the job.

The connection from the pot to the channel is normally not a simple junction but a blast agent valve of considerable complexity. Such valves are commonly not only capable of interdicting the flow of blast agent entirely but also of controlling the rate at which the blast agent can flow into the channel. In effect, the valve controls the size of the passageway from the pot into the channel. This permits the ratio of air to blast agent in the emerging stream to be changed by changing the setting of the blast agent valve. As in the case of adjusting the control valve, the usual practice has been to have someone else stationed at the pot to carry out such adjustments at the direction of the operator. While the inherent dangers in blasting require an additional person for the sake of safety, the difficulties of communication due to the noise, frequent poor visibility, and the fact that the operator is sometimes totally out of sight of the second person make it highly desirable that the operator be able to control both the stream and the blast agent by himself.

Dremann has disclosed a pneumatic blast agent valve and a system for controlling it in U.S. Pat. 4,075,789, but his control system, being pneumatic, is subject to the delay common in pneumatic dead man controls. While Dremann also, as a second embodiment, a manually operated form of his blast agent valve, his pneumatic system for modulating the size of the blast agent passageway cannot be used with that modification nor can it be used with other manually or mechanically operated blast agent valves.

It is also important for a blasting control system to be able, without degrading the response of the system to the normal operation of the dead man switch, to respond to a short-circuited cable or a broken cable automatically and to provide warnings related to specific malfunctions of the equipment.

OBJECTS AND SUMMARY OF THE INVENTION

It is an object of this invention to provide electrical means for the operator at the nozzle end of a blast hose to control both the stream of high-pressure air and the blast agent mixed with that stream.

Another object is to provide electrical means for generating signals at the nozzle end of the blasting hose to adjust apparatus that control the stream and the blast agent, collectively or individually.

Still another object is to provide an improved arrangement for a dead man switch.

Further objects will become apparent to those skilled in the art as they study the following description, together with the drawings.

In accordance with this invention, an electrical signal generator is attached at the nozzle end of a blasting hose in a position so that its controls are easily accessible to the person controlling that end of the hose. A source of electric power to operate the signal generator is located at the control center of the blasting system, usually near the blasting pot, and is connected to the signal generator, preferably by a three-conductor cable arranged to minimize stray signal pick-up. The signals generated by the signal generator are easily identifiably different from the operating voltage supplied by the power supply and include multiple frequencies. Controls are provided to select which signals are to correspond to various settings of the valves controlling the high-pressure stream and the blast agent incorporated in the stream. Analyzing means are located at the control center to receive and analyze the signals transmitted by the signal generator back along the same cable that carries power to the signal generator.

At least one of the signals represents the operating condition of the dead man switch when the hose operator grasps it for normal blasting. A different signal condition, such as no signal at all, represents release of the dead man switch, a third signal condition represents short-circuiting of the wires carrying power to the signal generator and information signals back from it to the analyzer.

DETAILED DESCRIPTION OF THE PREFERRED EMBODIMENT

Figure 1:
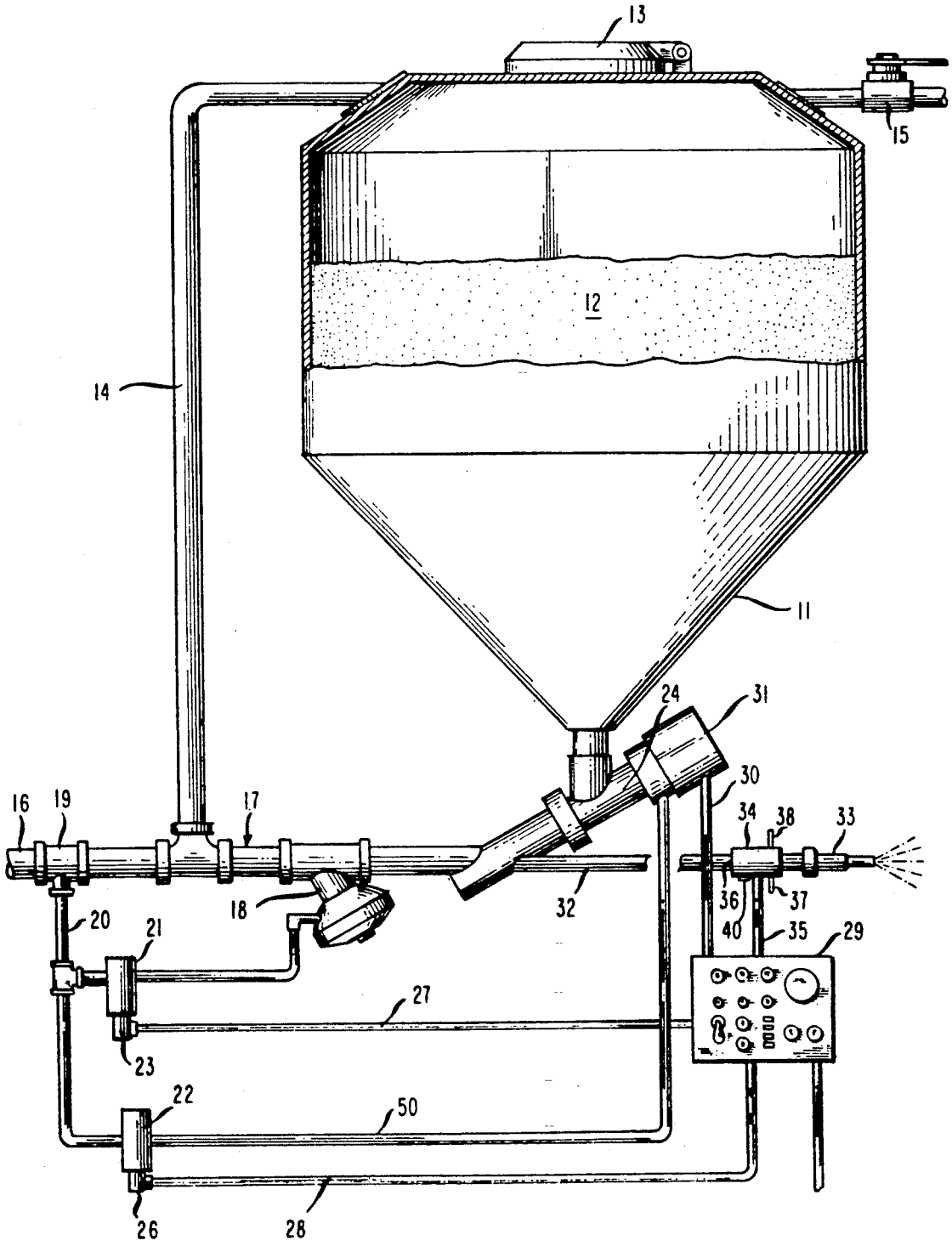
FIG. 1 is a schematic representation of a blasting system that incorporates this invention.

FIG. 1 shows blasting apparatus including a container, or blast pot, 11 partially filled with a blast agent 12 that may be sand, walnut shells, crushed iron slag, or any of the many other agents used in the blasting industry to remove materials, such as paint, rust, slag, and other materials, from a surface. The blast agent is put into the pot through an opening that is then sealed airtight by a hatch 13, after which the pot is pressurized by compressed air fed into it by way of a line 14 connected to the upper part of the pot. When more blast agent is to be placed in the pot 11, a pressure release valve 15 is opened to vent the compressed air in the upper part of the pot above the blast agent already in the pot.

The other end of the line 14 is connected to the end portion 16 of a high-pressure air channel 17. This is the input end of the channel, and it is connected to pressurizing means, such as an air compressor (not shown), capable of supplying a steady stream of air at a pressure usually in the range from about 90 to 140 p.s.i. A control valve 18, sometimes referred to as a slave valve, is connected in series with the channel 17 to control the stream of compressed air flowing through it. The control valve is operated by compressed air taken from the channel 17 at a Tee junction 19 and fed through a line 20 to two electrically controlled air valves 21 and 22. The valve 21 has a solenoid 23 that can be actuated by an electric current to open the valve to allow compressed air to pass through to open the control valve 18. This allows the stream of compressed air in the channel 17 to pass through. On the other hand, if the solenoid 23 is in its inactive state, it allows the valve 21 to close and prevent air from holding the control valve 18 open. The latter then closes, preventing air from flowing through the channel 17.

Downstream of the control valve 18 is a blast agent valve 24, which is part of a connection between the outlet of the blast pot 11 and the channel 17. The blast agent flows down through a port (not shown in this figure) in the channel 17 to enter, and be entrained by, the carrier stream of compressed air in the channel. The valve 24 is opened by air controlled by the air valve 22, which has a solenoid 26. When this solenoid is actuated, compressed air from the line 20 passes through the valve 22 and opens the valve 24 to allow blast agent 12 to pass through to the channel 17. When current is not being supplied to the solenoid 26, it allows the air valve 22 to shift to its alternative position, closing the valve 24 and the passageway through which the blast agent 12 passes to reach the channel 17.

Electric current to control the solenoids 23 and 26 is carried by supply lines 27 and 28, respectively, connected to a control center 29 normally located close to the pot 11. Another electric supply line 30 connects the control center to a control head 31 on the blast agent valve 24. This control head controls the extent to which the blast agent valve can open.

At least downstream of the blast agent valve 24, and in some blasting apparatus, within the blast agent valve, the channel 17 includes a flexible hose 32 that terminates in a nozzle end 33 from which a high-pressure stream of material emerges. In normal blasting operations, the stream includes blast agent 12 entrained in the stream of compressed air, but there are circumstances that dictate operating the control valve 18 and the blast agent valve 24 so that the stream emerging from the nozzle end of the hose 32 will be primarily air or primarily blast agent. A blast control transmitter 34 is secured to the hose 32 at the nozzle end 33 and is connected to the control center 29 by an electric line 35 that carries operating current to the transmitter and signals from the transmitter to control the operation of the blasting apparatus.

A dead man switch 36 is incorporated in the transmitter 34 to stop the high-pressure stream any time the operator releases his grasp on the switch. In order to make any other changes in the abrasive stream, it is currently standard practice for a safety person to be stationed near the control and blast agent valves to operate those valves in response to hand signals from the operator out at the nozzle end of the hose 32. The operator can signal for more blast agent to be fed into the stream of compressed air, and the safety person will comply by making hand adjustments of the blast agent valve, or the operator can signal the safety person to reduce the amount of blast agent 12 or even cut it off entirely. He can also wave to the safety person in such a way as to signal that the control valve must be closed momentarily to free a choked condition of blast agent clogging the blast agent valve 24. At best, the hand signals are subject to misinterpretation, and, when the blasting is being done inside a large container, such as the hold of a ship or the interior of a large tank, the signals cannot even be seen by the person expected to operate the valves.

Those difficulties are eliminated by this invention. The transmitter 34 in this embodiment is provided with a choke switch 40 in the form of a momentary-acting pushbutton to be pressed by the operator when he wants to have the control valve 18 closed so that the only pressure on the blast agent 12 in the pot will be from the top, thereby forcing out any clump of blast agent clogging the port into the channel 17.

An air-only switch 37 is provided on the transmitter to close the blast agent valve 24 and allow only the carrier stream of compressed air to pass through the channel 17 to clean loose material off of a surface. Since the air may be required for a longer period of time than it takes to get rid of a clump, the switch 37 is shown as an s.p.d.t. switch that can stay in either the air-only position or the normal blast position.

The transmitter 34 also has a mixture-control switch 38 that has three conditions. The normal position of the actuator handle of the switch is in the center, but it can be pushed one way to increase the percentage of blast agent in the air stream actuator or pushed the other way to decrease the blast agent. In either of the latter two conditions, the percentage of blast agent cannot be changed while the dead man switch is held closed and the blast stream is passing through the hose 32.

Figure 2:
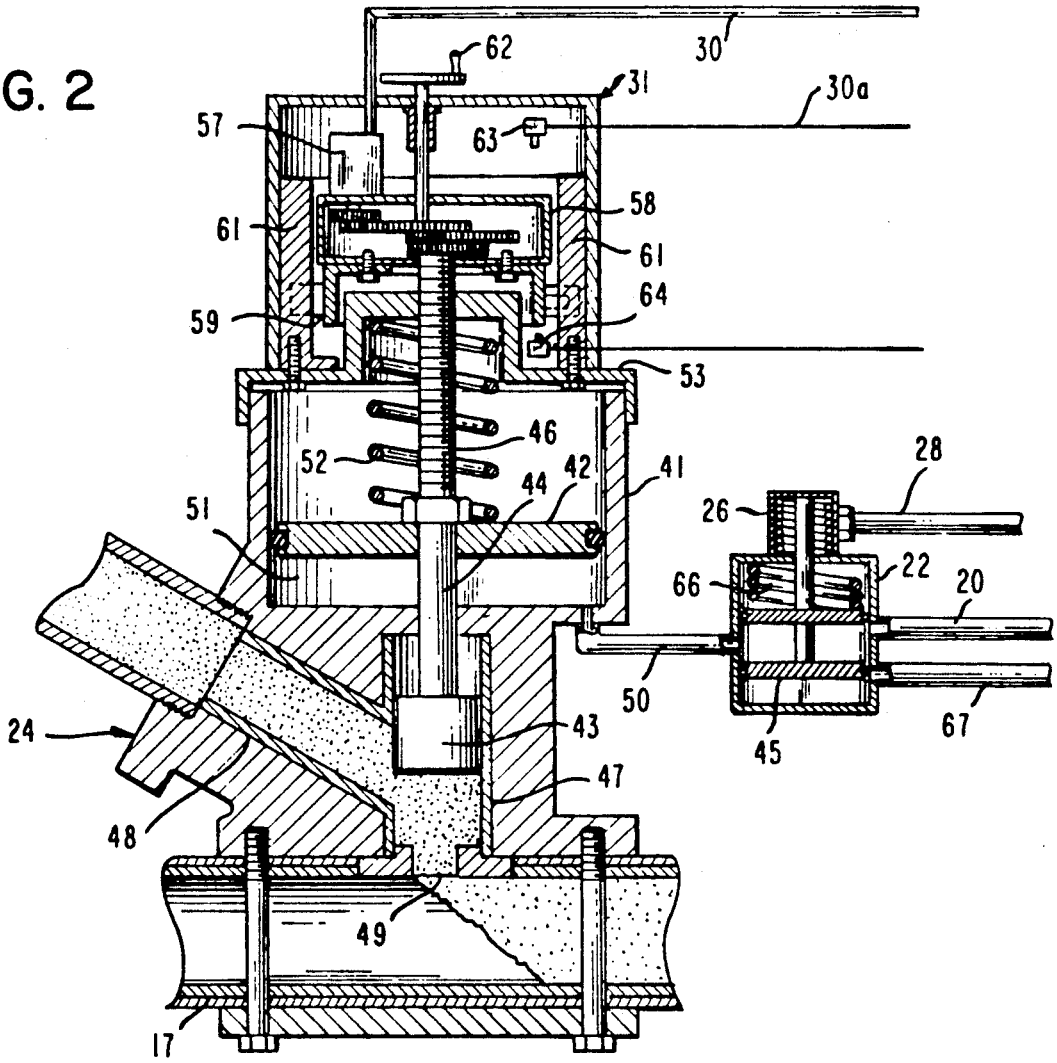
FIG. 2 is a cross-sectional view of the blast agent valve in FIG. 1 partially open to allow blast agent to pass through it.
Figure 3:
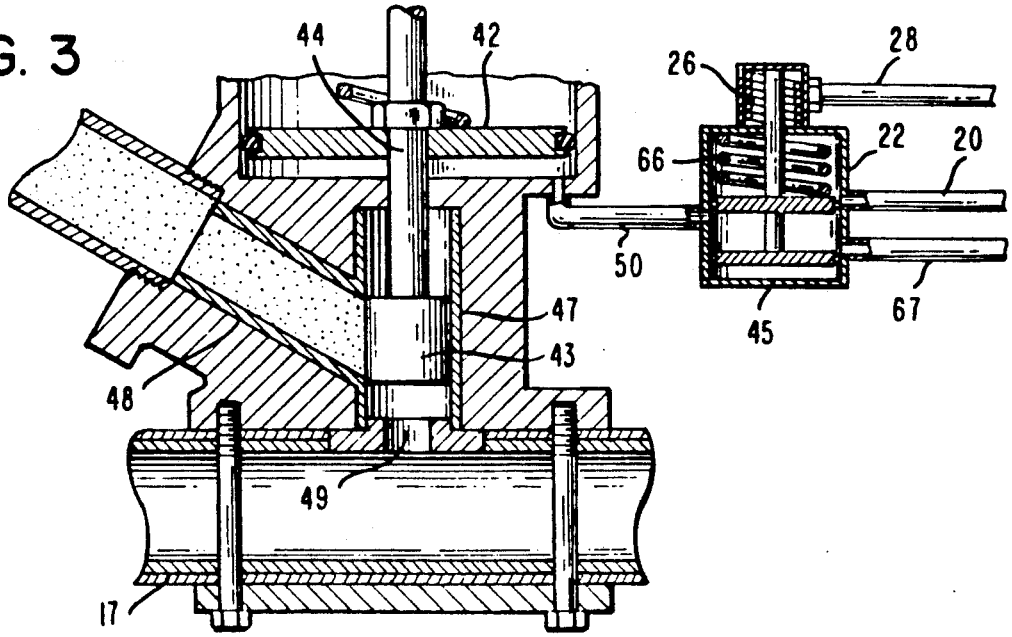
FIG. 3 is a cross-sectional view of part of the valve in FIG. 2 in the closed condition.

FIGS. 2 and 3 show the interior structure of a typical blast agent valve 24 and electrical control means 31 to control the operation thereof. The valve 24 includes a cylindrical casing 41 within which a piston 42 is mounted for longitudinal movement, which, in this case, is in the vertical direction. A second piston 43 of smaller diameter is affixed to a rod 44 in the center of the piston 42, and the piston 43 moves longitudinally in a cylinder 47. A side channel 48 constitutes a connection to the outlet of the blast pot 11, as shown in FIG. 1, and the piston 43 moves in a range of positions to block off more or less of the side channel. The lower end of the cylinder 47 is open and constitutes a port 49 to the channel 17.

The air valve 22 that controls the operation of the piston 42 and, thereby, the piston 43 is shown alongside the casing 41 and is connected to it by a pneumatic line 50. The air valve has a movable element in the form of piston 45, which is controlled by the solenoid 26. In this figure, the piston 45 is shown in its upper position, which allows the pneumatic line 20 to be connected through the valve 22 to the line 50 and on to the cylindrical casing 41 below the piston 42. As a result, the piston 42 is elevated to its uppermost position against a stop in the form of a screw 46 by the compressed air in a chamber 51 between the piston 42 and the bottom plate of the cylindrical casing 41. This elevation of the piston 42 is opposed by a large spring 52 that surrounds the screw 46 and is compressed between the piston 42 and a cylinder head 53 screwed onto the casing 41.

The electrical control means 31 is bolted to the top of the cylinder head 53 and is provided for the purpose of adjusting the stop that limits the upward movement of the rod 44 and, thus, the amount of the opening from the side channel 48 to the port 49 and the channel 17. This is done by rotating the screw 46, which engages a threaded hole in the cylinder head 53. The screw is rotated by an electric motor 57 mounted on a gearbox 58, which is attached to the screw to up or down with it as the screw is rotated in the threaded hole in the cylinder head 53, according to the direction of current flowing to the motor through the supply line 30. The gearbox is provided with bearings 59 that move in guides 61. A hand crank 62 is connected to one of the gears in the gearbox 58 to rotate the screw 46 if there is a problem with the motor 57. Limit switches 63 and 64 limit the movement of the gearbox 58, and therefore, the screw 46. These switches are connected to the control center 29 by an electric line **30*a* that is part of the multi-wire supply line 30**.

FIG. 3 shows the piston 43 in its lower position in which it closes the passageway from the side channel 48 to the channel 17. When the piston is in this position no blast agent can reach the channel 17, and it is the position of the piston when no blasting is going on or when the air-only switch 37 is actuated to allow the stream of high-pressure air to flow through channel 17 without receiving any abrasive material. This condition is sometimes necessary to clean residue off the surface that has been blasted. In order for the piston to move down to the position shown in this figure, the solenoid 26 must be de-energized, which allows a spring 66 in the air valve 22 to push the piston down to the position shown, thereby connecting the chamber 51 through the line 50 and the air valve 22 to an exhaust port 67.

Figure 4:
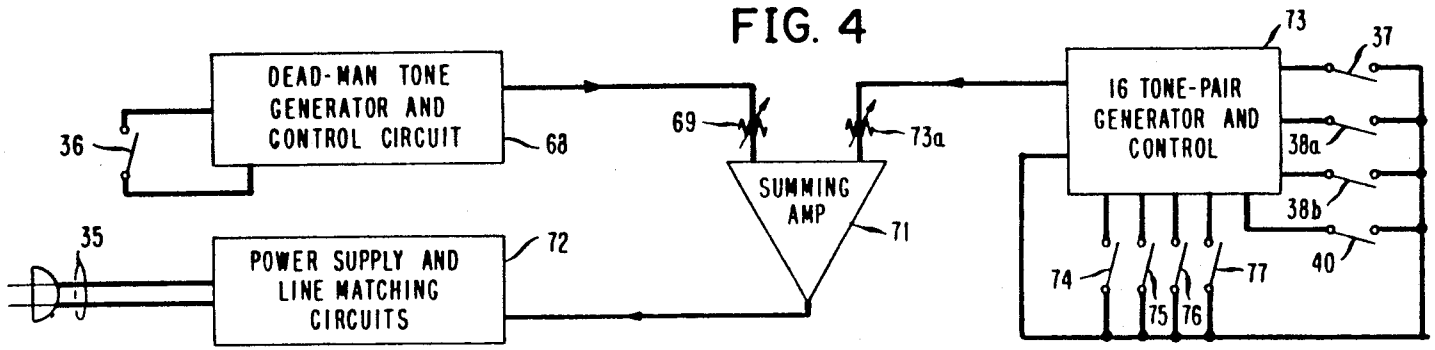
FIG. 4 is a block diagram of a signal generator for use in the control system of this invention.

FIG. 4 is a simplified block diagram of the transmitter 34 mounted at the nozzle end of the hose 32, as shown in FIG. 1. In this embodiment, the transmitter is a signal generator that generates a plurality of tones. The dead man switch 36 controls a tone generator 68 and causes it to generate a tone as long as the switch is held closed. This signal from the generator 68 is connected by way of a volume control 69 to a summing circuit 71. The summing circuit receives its operating power from the line 35 by way of a matching circuit 72 that allows the electrical power from the line to pass through to the summing amplifier and the dead man tone generator, as well as another tone generator 73. In addition, the matching circuit also passes signals from the tone generators 68 and 73 to the line 35 in such a way that there is no interference between the signal currents and the power current.

The tone generator 73 in this embodiment is capable of generating pairs of tones according to actuation of switches, which are here represented in simple form, but which correspond to the choke switch 40, the air-only switch 37, and separate switches 38*a* and 38*b* corresponding to the mixture-up (more blast agent) and mixture down (less blast agent) conditions, respectively. Since the generator 73 is capable of generating up to sixteen tone pairs, additional switches 74–77 are shown to allow for additional equipment to be added and for additional commands to be transmitted. The generator 73 is connected through its own volume control 73*a* to another input terminal of the summing amplifier 71. This amplifier can pass signals from the generators 68 and 73 at the same time, as is necessary for some of the commands.

Figure 5:
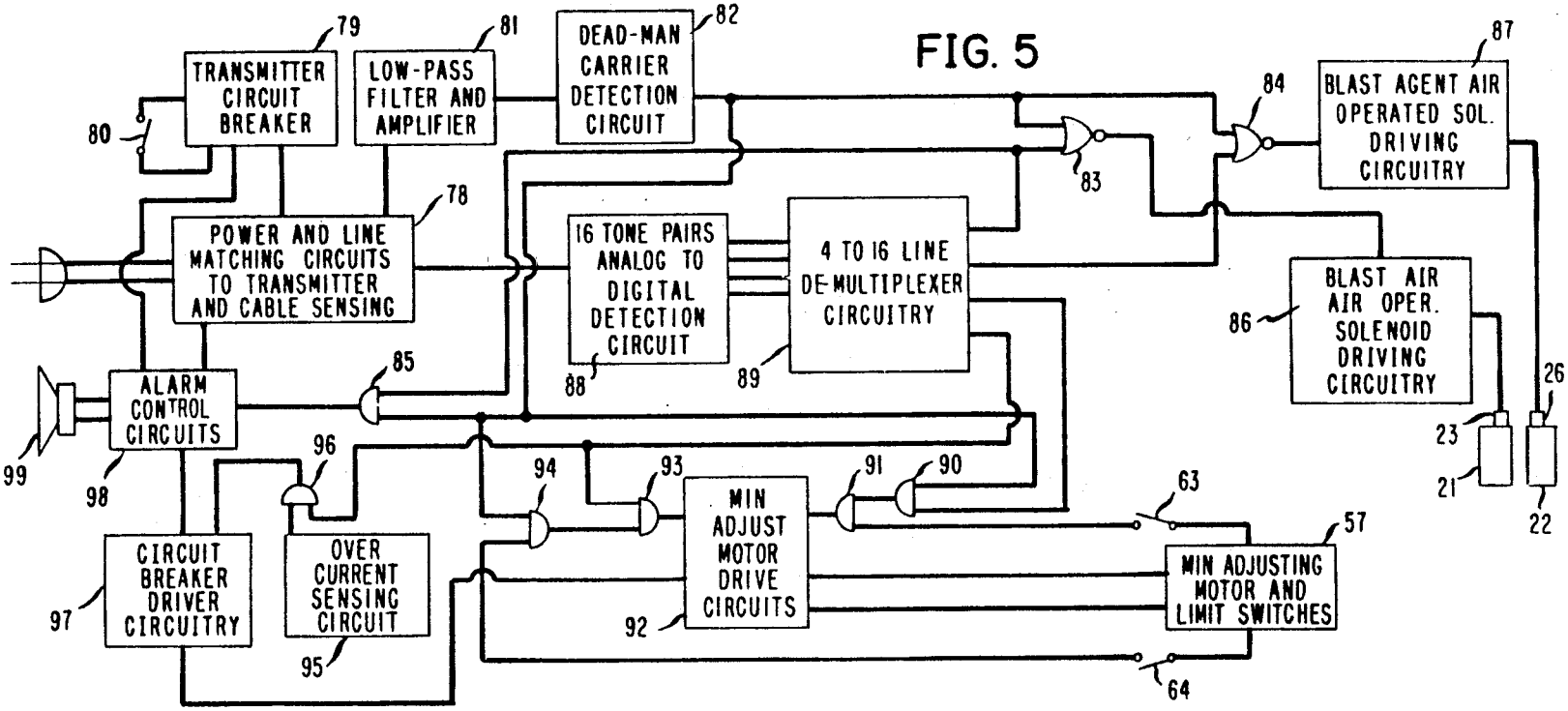
FIG. 5 is a block diagram of an analyzing circuit according to this invention.

FIG. 5 is a block diagram of an analyzing circuit for determining what commands, including absence of a tone from the generator 68 in FIG. 4, are being received at the control center 29 in FIG. 1. This circuit is linked to the signal generators in the transmitter 34 by the line 35, and the first part of the analyzing circuit connected to this line is a matching and cable-sensing circuit 78 to keep the power current separate from the information currents. This circuit is connected to a circuit 79 that is equivalent to a circuit breaker activated when power current to the transmitter 34 is excessive, as when the line 35 is short-circuited. For reasons that will be given hereinafter, a switch 80 is connected to the circuit 79 to turn on the transmitter 34 and to reset it if it goes off.

A low pass filter 81 is connected to the circuit 78 to pass the dead man tone, which has a lower frequency than the other tones received from the transmitter. The output signal of the filter 81 is applied to a detection circuit 82 to determine whether or not there is a dead man tone. The output signal of this detection circuit is a binary signal and is applied to two NOR gates 83 and 84 and to an AND gate 85. The output of the NOR gate 83 is connected to a circuit 86 that drives the solenoid 23 of the air valve 21 that controls the valve 18. The other NOR gate 84 is connected to a circuit 87 that drives the solenoid 26 of the air valve 22 that controls the blast agent valve 24. The detection circuit 82 operates in such a way that it produces a low, or 0, signal when it receives a tone indicating that the dead man switch 36 is being held shut by the operator, and it produces a high, or 1, signal when there is no dead man tone. This is negative-true logic, and the valves 18 and 24 are not allowed to be open if there is no dead man tone.

Also connected to the circuit 78 to receive the tones from it is an A/D detection circuit 88 that responds only to the tone pairs from the transmitter and does not respond to the dead man tone. The response is to provide a four-bit digital output signal on the four lines leading to a 4-to-16 line de-multiplexing circuit 89 that analyzes the four-bit input signals from the circuit 88 and provides a single output status signal on any one of up to sixteen lines, according to the sixteen possible combinations of four-bit signals from the circuit 88. In this figure, the circuit 89 is arranged to supply only four of the possible sixteen signals taken from it. One of these signals is connected to the NOR gate 83 as a second input signal for that gate. If both inputs to this NOR gate are 0, the output of the gate will be a 1 and will cause the circuit 86 to energize the solenoid 23 to open the control valve 18 (FIG. 1) and allow high-pressure air to pass through the channel 17. Having a low value on both of these inputs to the NOR gate 83 means that the dead man tone is being received and that there is no choke signal.

A second output circuit of the de-multiplexing circuit 89 is connected to the NOR gate 84, which also receives a signal from the dead man detection circuit 82. When both input signal to the NOR gate 84 are low, it is because the air-only switch 37 is in the normal blast mode and the dead man switch 36 is closed, causing the dead man tone to be received.

A third output signal from the de-multiplexing circuit 89 is connected to an AND gate 90 and has the value 1 when the operator chooses to increase the amount of blast agent in the mixture of blast agent and compressed air in the blasting stream. A second input to this AND gate is connected to the output of the dead man tone detection circuit 82 to receive a 1 when the switch 36 is not being gripped by the operator, i.e., when no blasting is being done. These conditions cause the AND gate 90 to apply a 1 to a second AND gate 91. The other input to this AND gate is taken from one of the limit switches 63 and will be a 1 if that switch is open, indicating that the gearbox 58 in FIG. 2 is not all the way to the top of its range of travel. A 1 on both of the inputs to the AND gate 91 will cause that AND gate to output a 1 to the circuit 92 controlling the motor 57 to cause it to raise the screw 46.

The fourth output terminal of the de-multiplexer circuit 89 is applied to an AND gate 93 to cause that AND gate to output a 1 to the circuit 92 to cause the motor 57 to move the screw 46 down, thereby reducing the amount of blast agent in the blasting stream. In order for the AND gate 93 to output a 1, its other input must receive a 1 from an AND gate 94 controlled by signals from the dead man tone detection circuit 82 and from the limit switch 64. If the gearbox 58 is not all the way to the bottom of its range of travel, the output from the switch 64 will be a 1. The signal from the circuit 82 will be a 1 if the operator is not attempting to blast and has released his grip on the dead man switch 36.

In the case of an attempt to reduce the amount of blast agent in the mixture, which means forcing the piston 43 down, it is possible for the motor 57 to be overloaded and draw too much current. If that were to happen, the motor could burn out. To prevent it from happening, the circuit in FIG. 5 includes an over-current sensing circuit 95, the output of which is connected to one of the input terminals of an AND gate 96. The output of the sensing circuit 95 is a 1 when the current to the motor 57 is too high. The other input terminal of the AND gate 96 is connected to the same output terminal of the de-multiplexing circuit 89 that is connected to one of the input terminals of the AND gate 93 and has a 1 on it when the operator is signaling for a reduction in the amount of blast agent in the mixture. Thus, when the operator is signaling for less blast agent in the mixture and the motor 57 is overloaded, the AND gate 96 outputs a 1 to a circuit 97 that operates as a circuit breaker, cutting off operating current to the motor drive circuit 92 and stopping the motor. At the same time, the circuit sends an alarm signal to an alarm circuit 98. This circuit is connected to a horn 99, as well as other indicators, to indicate that there is a malfunction in the system.

Figure 6:
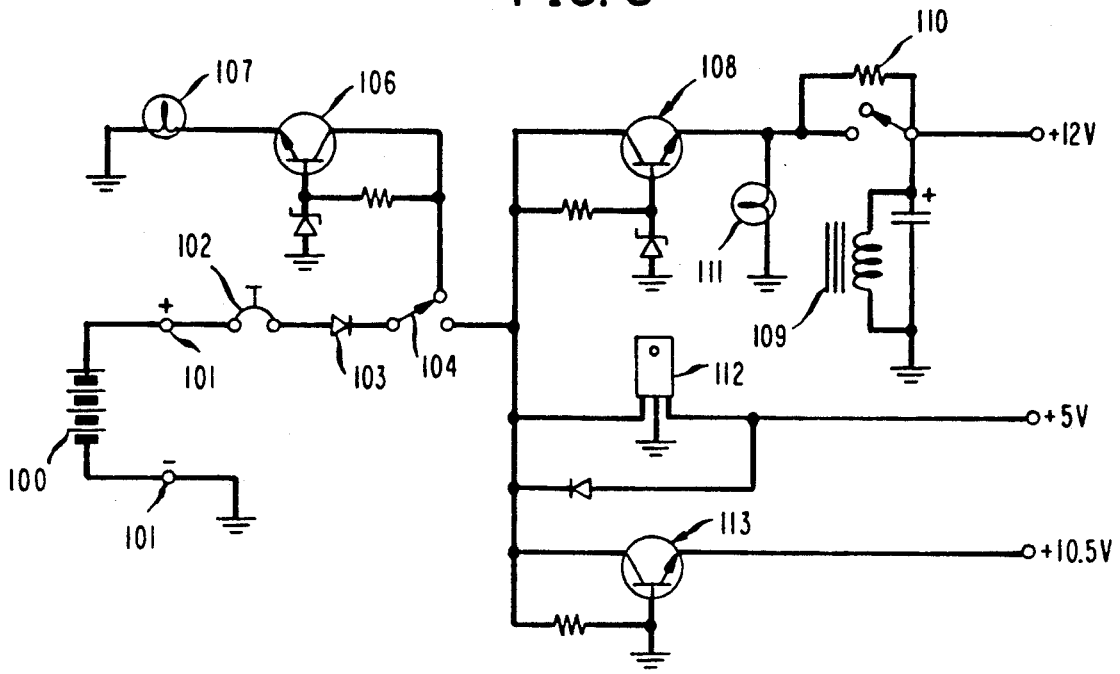
FIG. 6 is a schematic diagram of the power supply of this invention.

The control system of this invention is capable of operating on any direct voltage source from 12 v. to 24 v., and the circuits in FIG. 6 are arranged to make this possible. The main supply 100 is connected across the power supply terminals 101 and in series with a circuit breaker 102, a diode 103 that prevents connecting the terminals 101 to the source 100 in the wrong polarity, and an s.p.d.t. ON-OFF switch 104. The switch is shown in the OFF position in which it is connected to an indicating circuit 106 that includes a lamp 107. This lamp is on only when the system is connected to a power source in the correct polarity and the switch 104 has not been turned ON.

When the switch 104 is changed to the ON position, the source 100 is connected through to three circuits that control the three levels of operating voltage required by various parts of the system. The first circuit 108 allows no more than 12 v. to be connected to alarm circuits and, by way of the contacts of a relay 109, to solenoids 23 and 26 and the motor 57. An indicator light 111 is connected across the input part of this circuit to indicate when it is operating.

A resistor 110 is connected across the relay contacts to provide a time delay during the turn-on interval just after the switch 104 has been closed. This delay allows time for the solenoid drive circuits 86 and 87 and the motor drive circuit 92, which are initially conductive, to reset to the OFF condition. Until these drive circuits become non-conductive, they constitute a low impedance of about ten ohms, and having the resistor 110, which is about 70 to 100 ohms and preferably about 82 ohms, in series with the drive circuits prevents an initial surge that would cause the blast agent valve 24 and the control valve 18 to open for about a second immediately after the switch 104 is closed. This initial surge, if it were allowed to happen, would initiate normal blast mode operation for the initial second, and that could be very dangerous. The voltage drop across the resistor is sufficient to prevent the solenoids 23 and 26 controlling the valves 18 and 24 from being able to open those valves. This voltage drop also causes the voltage across the coil of the relay 109 to be low, initially, thereby keeping the relay from being energized. After the circuits reset, the resistance of the relay coil, alone, is high enough so that the voltage drop across the resistor 110 falls to a value low enough to allow the relay to be actuated, shorting out the resistor 110 and applying full voltage to the solenoid and motor drive circuits.

A standard voltage regulator 112 is connected to the switch 104 to drop the main power supply voltage to 5 v. necessary for some of the circuits, such as the receiver circuit, and a series regulating circuit 113 is arranged to drop the main power supply voltage to about 10.5 v.

Figure 7:
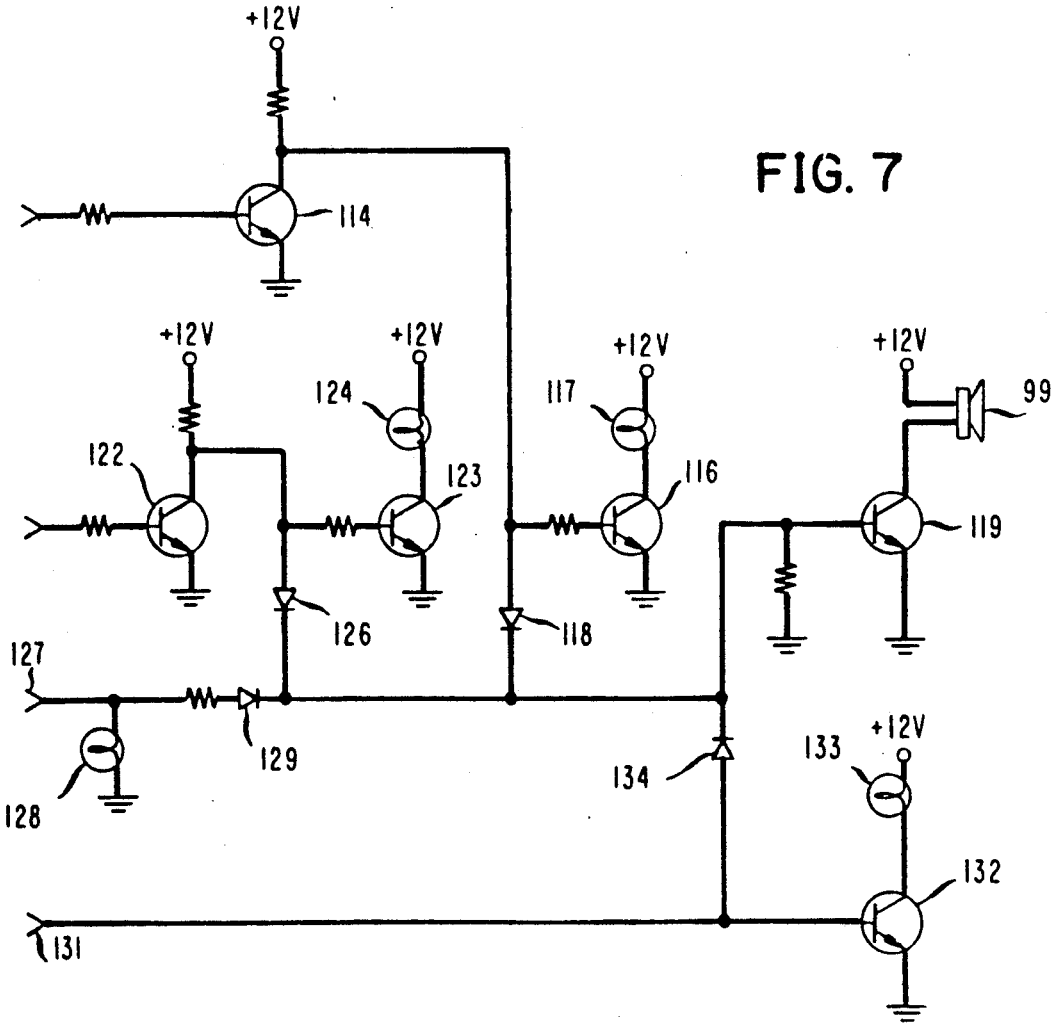
FIG. 7 is a schematic diagram of the warning circuit of this invention.

The control system includes warning lights and the horn 99 to indicate various malfunctions of the blasting equipment. These warning devices are shown in FIG. 7. One fault that must be indicated is the short-circuiting of the power supply cable 35 that carries operating power to the transmitter 34 in FIG. 1. The base of a transistor 114 is connected to a protective circuit that responds to the overload condition on the power supply cable, such as may be due to a short circuit. If this cable is short-circuited, the base voltage to the transistor 114 will drop and the collector voltage will rise. As a result, the base voltage to a transistor 116 will rise, making that transistor conductive and turning on a warning light 117. The rising voltage to the base of the transistor 116 is connected to a diode 118 polarized to cause the base voltage of a transistor 119 to rise. This makes the transistor 119 conductive and equivalent to a closed switch in series with the warning horn 99, or the like. The sound from this horn is one way of providing audible signals from the operator to the safety person in the vicinity of the pot 11 and the control center 29 in FIG. 1.

If the power supply cable 35 to the transmitter 34 is broken so that it is open-circuited, that fact causes a drop in the voltage applied to the base of a transistor 122, which makes that transistor non-conductive and allows the voltage at its collector to rise. This condition causes the base of a transistor 123 to rise, making that transistor conductive and thereby drawing current through a light 124, which turns that light on. The voltage applied to the base of the transistor 123 is connected through a diode 126 to the base of the transistor 119 connected to the horn 99. As a result, the horn is actuated when the light 124 goes on.

Another terminal 127 in the alarm control circuit in FIG. 7 is connected to a circuit connected to the motor 57. When that motor draws excessive current, the voltage applied to the terminal 127 goes positive, lighting a warning light 128. This voltage is of the proper polarity to pass through a diode 129 to the transistor and cause that transistor to become conductive and to turn on the horn 99 when the light 128 goes on.

The remaining circuit in FIG. 7 is connected to a beeper control terminal 131. When that terminal goes positive, a transistor 132 is made conductive, causing a light 133 in series with the emitter-collector circuit thereof to turn on. The positive voltage is also connected through a diode 134 to the base of the horn transistor 119, again causing the horn to sound. The beeper is more of a communication means than a warning means, and the light 133 indicates which operator is seeking the safety person's attention, in case the system is arranged to have more that one blasting hose 32 and, therefore, more than one operator.

Figure 8:
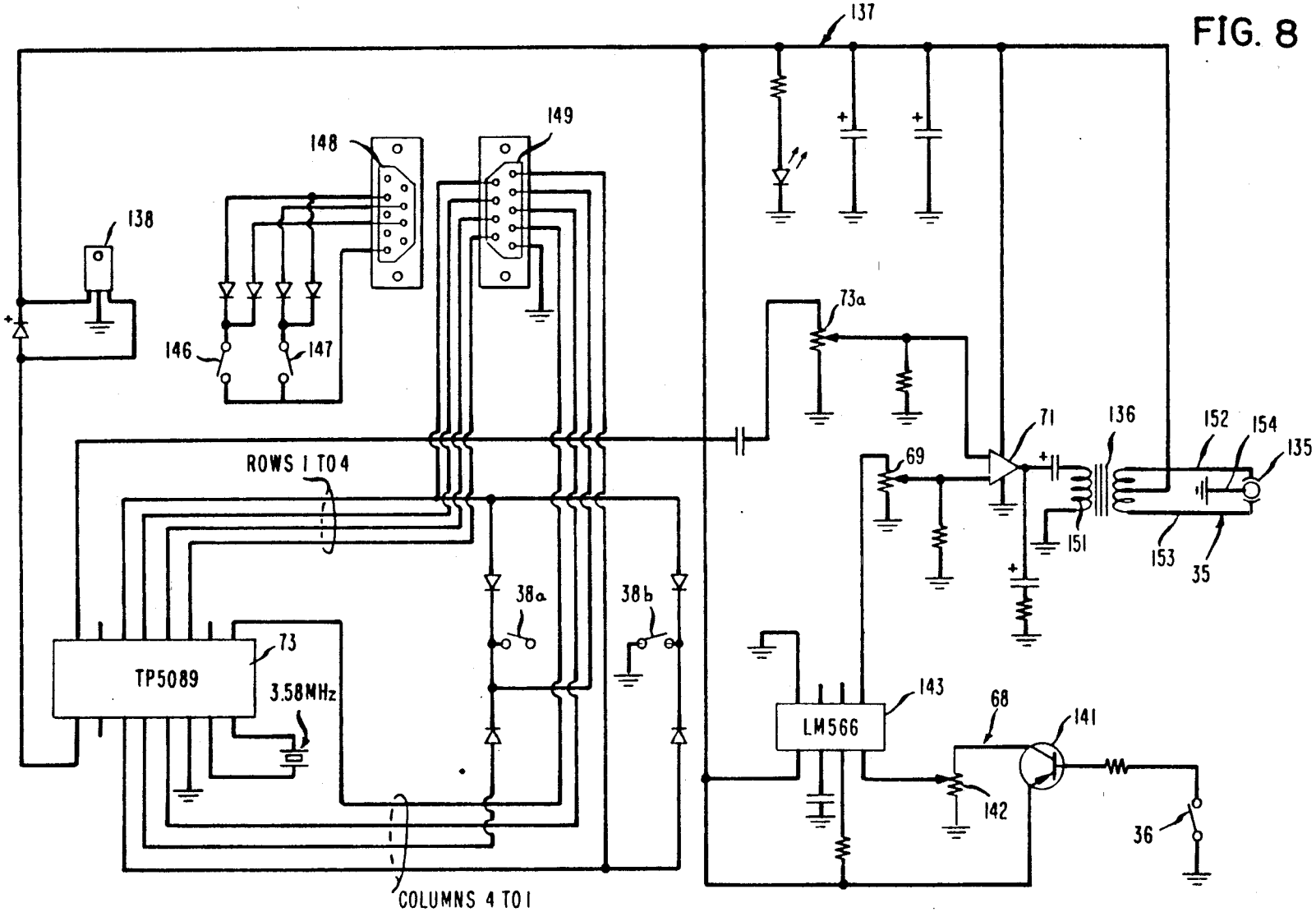
FIG. 8 is a schematic diagram of the transmitting circuit of this invention.

The transmitter circuit in FIG. 8 shows one end of the cable 35 in more detail. This is a three-wire cable and is connected to a three-terminal plug 135 of the locking type so that it will not be inadvertently disconnected. Two of the wires in the cable are connected to the ends of a center-tapped winding of a transformer 136, while the third wire is connected to a ground terminal on the transmitter 34. Current to operate the transmitter circuit is carried in the same direction in both of the first and second wires of the cable 35 and, thus, in opposite directions in the two parts of the center-tapped winding. As a result, these currents buck each other out and do not adversely affect the operation of the transformer. The center tap is connected to a smoothing circuit 137 to remove any extraneous signals that might have been picked up, and the smoothing circuit is connected to a voltage regulator 138 that provides regulated voltage to the tone-pair generator 73. Unregulated operating voltage is applied to the tone generator 68 that generates the single dead man tone.

The normally open dead man switch 36 is connected between ground and the base of a PNP transistor 141, the emitter of which is connected to the smoothing filter 137 and the collector of which is connected to ground through a potentiometer 142 that serves a load for the transistor. A tone generator 143 that generates the dead man tone is connected to the arm of the potentiometer, which controls the frequency of the tone. The potentiometer 142, and the generator 143, together constitute the signal generator 68 in FIG. 4, and the transistor 141 is controlled by the switch 36 to allow the tone generator to generate its tone when the switch 36 is closed.

The tone-pair generator 73 is shown with only two of the switches, the switch 38*a* to increase the blast agent in the blasting stream and the switch 38*b* to reduce the blast agent, connected to it. Closing one of these switches causes the tone generator, which is a TP 5083, to generate one pair of tones and closing the switch 38*b* causes it to generate another pair of tones. Any other switches similarly connected to one of the row lines 144 and one of the column lines of the tone generator 73 causes it to generate another pair of tones according to which row and which column are connected to ground through that switch. Two of such other switches 146 and 147 are shown in an optional circuit connected by connectors 148 and 149 to the tone generator 73.

The output signals from the generators 143 and 73 are connected through their respective volume controls 69 and 73*a* to the summing amplifier, the output circuit of which is connected across the winding 151 of the transformer 136. This causes the tones to be coupled to the center-tapped winding so that the tone currents flow in opposite directions in the two wires 152 and 153 of the cable 35. Therefore, these tone currents do not flow in the line that carries the power current to the smoothing circuit 137 and do not interfere with it, nor does it interfere with them.

Figure 9A:
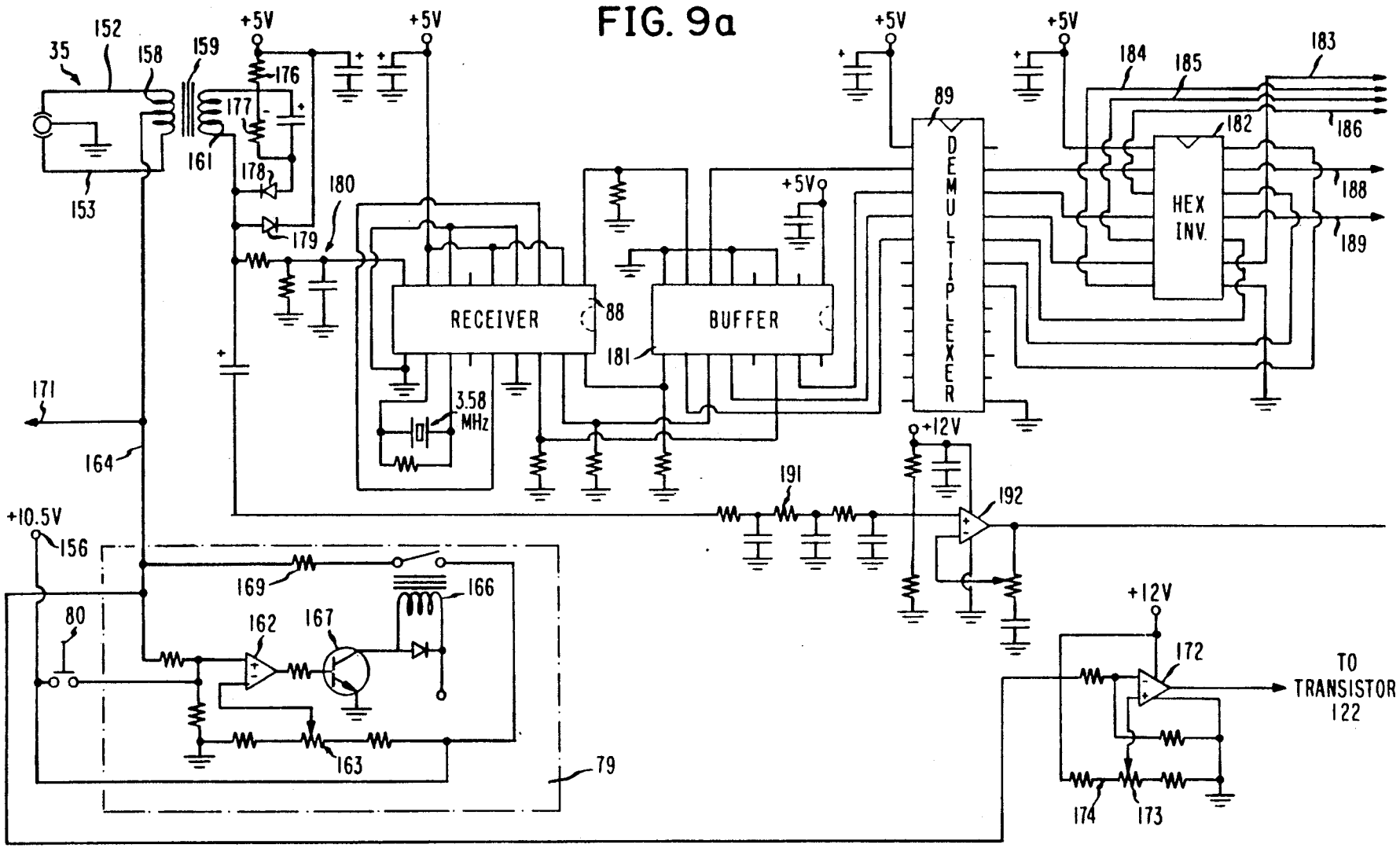
FIGS. 9*a* and 9*b* are schematic diagrams of the analyzing circuit of this invention.
Figure 9B:
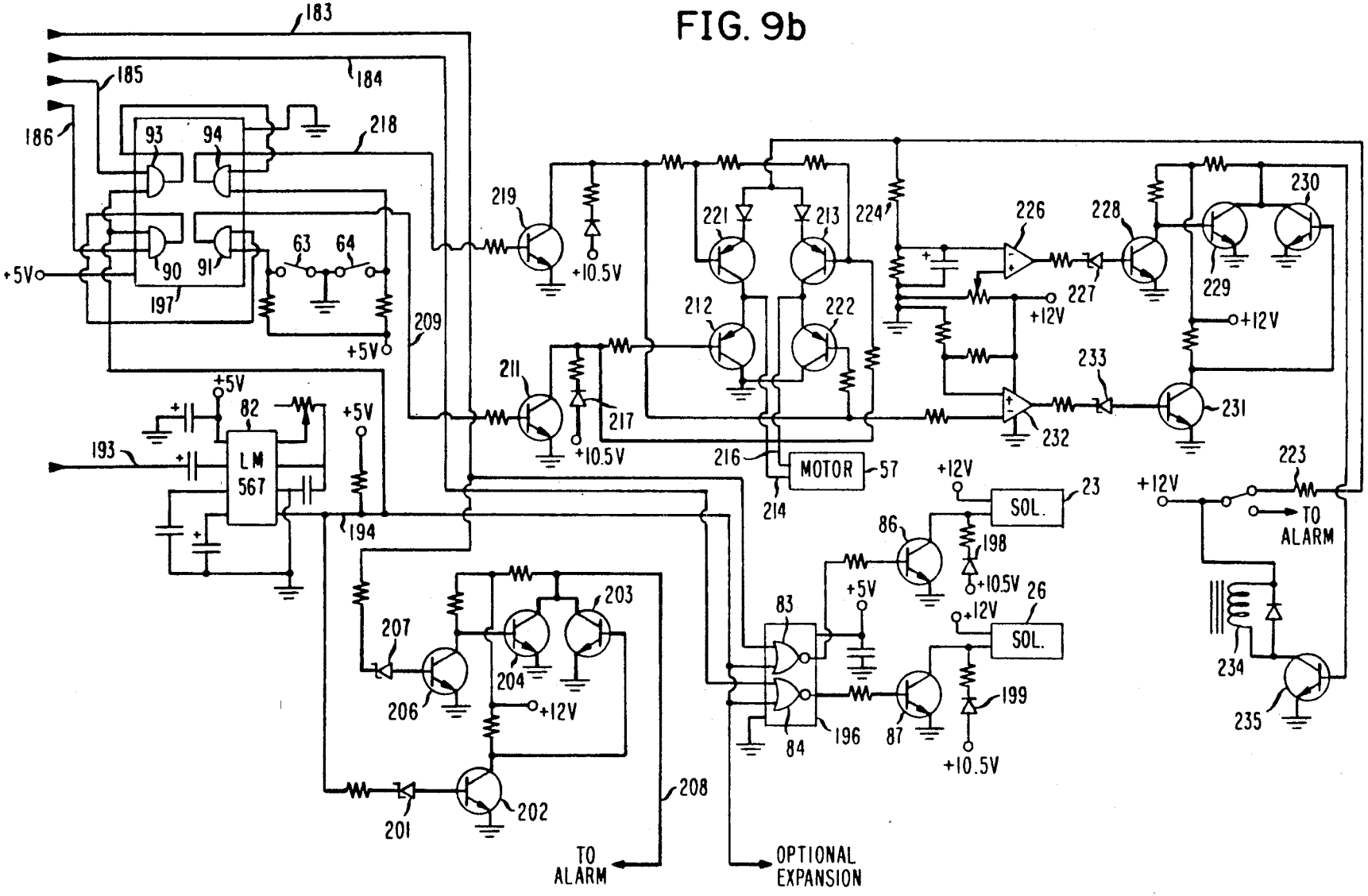

FIGS. 9*a* and 9*b* show circuits in the control center 29 in FIG. 1. A terminal 156 is connected to the regulating circuit 113 in FIG. 6 to have the 10.5 v. operating voltage from that regulator impressed on it. The terminal is connected through a transmitter circuit breaker 79 to the center tap of a winding 158 of a transformer 159, and current form the terminal 156 flows out through both of the lines 152 and 153 in the same direction to the transformer 136 in FIG. 8. Tone signals from the transformer 136 flow in opposite directions and so are impressed across the winding 158 and are passed through the transformer 159 to its output winding 161.

The circuit breaker 79 includes a comparator 162, the inverting terminal of which is connected to a controllable point in a voltage divider 163 connected between the terminal 156 and ground. The non-inverting terminal of the comparator is connected to the line 164 that carries operating current for the transmitter 34. Initially, this line has no voltage applied to it, because the normally-open terminals of a relay 166 are connected in series between the terminal 156 and the line 164. The relay coil is connected in series with the emitter-collector circuit of a transistor 167, and the output circuit of the comparator 162 is connected to the base of this transistor to control its conductivity. The output voltage of the comparator goes high when the voltage on its non-inverting terminal goes up with respect to the voltage on the inverting terminal. In order to cause that to happen each time the system is put into operation, a momentary-action pushbutton switch 80 is connected between the terminal 156 and the non-inverting terminal of the comparator 162 to allow the full operating voltage to be applied to the non-inverting terminal to start that part of the circuit after the main switch 104 in FIG. 6 has been placed in the ON position. This causes the comparator to bias the transistor 167 to conductivity, drawing current through the coil of the relay 166 and causing its contacts to close. This carries the operating voltage through to the line 164, which carries operating current to the transmitter.

The circuit breaker 79 protects the system from excessive currents, such as would occur if the wires 152 or 153 of the cable 35 were short-circuited to the third wire. If that happened, the current through the line 164 would cause a higher than normal voltage drop across a resistor 169 in series with the line 164. That would cause the output voltage of the comparator 162 to decrease, thereby causing the transistor 167 to become non-conductive and allowing the relay terminals to open. A terminal 171 connected to the line 164 is connected to base of the transistor 114 of the alarm circuits in FIG. 7.

The inverting terminal of another comparator 172 is connected to the line 164 to compare the voltage on that line with a selected fraction of the voltage from the circuit 108 in FIG. 6. This fraction is selected by the setting of a potentiometer 173 in a voltage divider 174. If the voltage on the line goes higher than it should, such as would happen if the cable 35 broke, the output voltage of the comparator 172, which is connected to the base of the transistor 122 in the alarm circuits in FIG. 7, would go down, causing the warning light 124 and the horn 99 to go on. A broken cable 35, would, of course, cause the dead man tone from the transmitter to cease, thereby turning off the blasting operation.

The output voltage of the transformer 159 across the winding 161 is biased by a voltage divider comprising resistors 176 and 177 to a level such that the tone signals would vary about a voltage of about 2.5 v. A diode 178 connected to ground and another diode 179 connected to the +5 v. operating voltage from the voltage regulator 112 in FIG. 6 prevent the tone signals from going below 0 v. or above 5 v. This is necessary in this embodiment, because the dual-tone receiver 88 to which these signals are applied, after passing through a low-pass filter 180, is a CMOS circuit that cannot handle signals higher than about 5 v. or lower than about 0 v.

The receiver 88 converts the analog tone signals to four-bit digital signals, which are applied to a buffer 181 that makes the signals from the CMOS circuit 88 suitable for the de-multiplexer 89. This circuit analyzes the four-bit digital signal and produces an output signal on any one of up to sixteen output lines. In this embodiment, the output signals from the de-multiplexer 89 have negative logic and are passed through an inverter 182 to change them to positive logic. Only four output lines 183–186 are used for the de-multiplexed signals, although two extra lines 188 and 189 that might be used to control additional apparatus are shown.

The tone signals from the transformer winding 161 are also applied through a low-pass filter 191, which passes only the dead man tone to an op-amp 192, the output circuit of which is connected to a line 193.

The line 193 is connected to the detection circuit 82 in FIG. 9*b*. This is an LM 567 phase-locked loop detector that feeds a saturated transistor across its output circuit between the line 194 and ground. As a result, this line is low when there is a dead man tone and high when there is not, which is negative-true logic. The line 194 is connected to the two NOR gates 83 and 84 in a chip 196 and to two AND gates 90 and 94 in another chip 197. The second input to the NOR gate 83 is obtained from line 183 and is the choke signal. The output of this NOR gate is connected to the base of a transistor 86, which is the circuit that drives the solenoid 23 that controls operation of the main air control valve 18 in FIG. 1. The second input to the NOR gate 84 is obtained from the line 184 and is the air-only signal. The output of this NOR gate is connected to the base of the transistor 87, which is the circuit that drives the solenoid 26 that controls the blast agent valve 24 in FIG. 1. Light-emitting diodes 198 and 199 are connected to the transistors 86 and 87, respectively, to be turned on when those transistors are conductive.

The line 194 from the circuit 82 is also connected through a zener diode 201 to the base of a transistor 202, the collector of which is connected to the base of a transistor 203. The emitter-collector circuit of the latter is connected in parallel with the emitter-collector circuit of another transistor 204, the base of which is driven by the output signal from a transistor 206. The choke line 183 is connected through a zener diode 207 to the base of the transistor 206.

When there is no dead man signal, the line 194 is high enough to overcome the required voltage across the zener diode 201 and cause the transistor 202 to conduct. This drives its collector low and makes the transistor 203 non-conductive. On the other hand, if there is a dead man signal, the transistor 203 will be conductive. The transistor 206 will be conductive and the transistor 204 will be non-conductive if there is a 1 on the choke line 183. Conversely, the transistor 206 will be non-conductive and the transistor 204 conductive if there is no choke signal on the line 183. Only if there is a choke signal and no dead man signal will the output line 208 be high. This line goes to the base of the transistor 132 in FIG. 7 via terminal 131 to cause the horn 99 to sound. The operator can use this as a signaling means by releasing pressure on the dead man switch and briefly touching the choke button 40 to beep the horn 99.

When the operator desires to increase the amount of blast agent in the blasting stream, he moves the actuator of the switch 38 to its "Increase" position. This produces a 1 on the line 188. If the screw 46 in FIG. 2 is not all the way at the top of its range of travel, the switch 63 and the AND gates in the chip 197 will produce a 1 on a line 209 leading to the base of a transistor 211, causing that transistor to become conductive and pull its collector low. This causes a transistor 212 and another transistor 213 to become conductive. Lines 214 and 216 connected to these transistors are in series with the motor 57 in FIG. 2, and, when these two transistors are conductive, current flows through these lines and through the motor in the proper direction to cause the motor to move the screw 46 up. This can only be done when no blasting is going on, that is, when the operator is not holding the dead man switch 36 closed. An L.E.D. 217 is connected in series with the emitter-collector circuit of the transistor 211 to be turned on when the amount of blast agent in the mixture is being increased.

When the operator desires to decrease the amount of blast agent in the mixture, he moves the actuator of the switch 38 in the opposite direction, and the tone generator 73 in FIG. 4 produces a tone pair that is detected in the receiver 88 in FIGS. 5 and 9*a* and deciphered in the de-multiplexer 89 to produce a 1 on the line 185. This is applied to the AND gates in the chip 197, and if the limit switch 64 is not closed, indicating that the screw 46 in FIG. 2 is not already at the bottom of its range of travel, a 1 will be produced on a line 218 leading to the base of a transistor 219. That causes the transistor 219 to become conductive, which pulls its collector low and causes transistors 221 and 222 to become conductive. This causes current to flow in the opposite direction in the lines 214 and 216 and the motor 57, thereby moving the screw 46 in FIG. 2 down and closing off the passageway from the side channel to a greater degree.

A problem that can occur when the piston 43 is being forced down by the screw 46 is that a hard substance may be partially blocking the path of that piston in the cylinder 47. This could cause the motor 57 to be overloaded and to burn out. In order to protect the motor, FIG. 5 shows an over-current sensing circuit 95, an AND gate 96 and a circuit-breaker circuit 97. These components are shown in greater detail in the following part of FIG. 9*b*.

Current to the transistors 212, 213, 221, and 222, and the motor 57 is drawn through a resistor 223, which may be of low resistance, such as less than one ohm. A voltage divider 224 is connected between the resistor 223 and ground, and the inverting terminal of a comparator 226 is connected to a suitable tap on the voltage divider. The output of the voltage divider is connected through a zener diode 227 to the base of a transistor 228, the output circuit of which is connected to the base of a transistor 229. The emitter-collector circuit of this transistor is connected in parallel with the emitter-collector circuit of another transistor 230.

The collector of the transistor 219, in addition to being connected to the base of the transistor 222, is also connected to the inverting terminal of a comparator 232, the output of which is connected through a zener diode 233 to the base of the transistor 231. The output circuit of this transistor is connected to the base of the transistor 230. The transistors 229 and 230 are connected as an OR gate, but the transistors 228 and 231 make the circuit containing those four transistors an AND gate identified in FIG. 5 as the AND gate 96.

The collectors of the transistors 229 and 230 is connected to the base of a transistor 235, the emitter-collector circuit of which is in series with the coil of a relay 234. The contacts of this relay operate as an s.p.d.t. switch, and when the transistor 235 is non-conductive, the arm of the relay is in series between the 12 v. power supply and the resistor 223. When the transistor is conductive, the arm is moved to its alternative position, which disconnects the power supply from the resistor and all of the circuit components supplied with operating current through that resistor, including the motor 57. At the same time, having the transistor 235 become conductive connects the 12 v. power supply to a terminal 236, which is connected to the terminal 127 in the alarm circuit in FIG. 7.

When the transistor 219 is made conductive as a result of the command to reduce the amount of blast agent in the mixture, and assuming the dead man switch is not being gripped by the operator and that the limit switch 64 is not closed, the transistor 231 will become conductive, pulling the base of the transistor 230 low and rendering that transistor non-conductive. The transistor 235 will start off being non-conductive, which means that the arm of the relay 234 will be in the position shown and current can flow through it to the resistor 223, the motor 57 and its drive circuit, and the voltage divider 224. As long as the motor 57 is not drawing too much current, the voltage drop across the resistor 223 will be at the correct value, and the voltage on the inverting input terminal will be high enough to keep the transistor 228 non-conductive. This will keep the transistor 229 conductive, which will keep the base voltage of the transistor 235 low.

If the motor starts to draw too much current, due to an interruption in the travel of the piston 43, the voltage drop across the resistor 223 will increase, and the voltage at the inverting input terminal of the comparator 226 will go down. This will cause the voltage applied to the zener diode 227 to go up, and when it exceeds the breakdown voltage of the zener, the voltage on the base of the transistor 228 will go up, soon causing that transistor to become conductive. When that happens, the base of the transistor 229 will go down, causing that transistor to become non-conductive. Since the transistor 230 is already non-conductive, due to the fact that the command has been given to reduce the amount of blast agent in the mixture, the voltage on the collectors of the transistors 229 and 230 will rise, making the transistor 235 conductive and causing the arm of the relay to be drawn to the other contact. As a result, current to the motor will be stopped, and the horn 99 will sound, indicating, in this instance, that there is a problem related to the motor.

We claim:

1. A blasting system comprising:

a blast agent container having a blast agent outlet;

means to pressurize the container;

channel means comprising an input end, a blast agent port, and a flexible hose portion having a nozzle end;

pressurizing means connected to the input end to supply a carrier stream under pressure to the channel means;

connection means connecting the blast agent outlet of the container to the blast agent port of the channel means to allow the blast agent entering the channel means to become entrained in the carrier stream;

solenoid means to control the passage of the blast agent through the hose;

electrical power supply means;

electrical signal generating means located at the nozzle end and connected to the power supply means and comprising controls to control the signal generating means to impart blast requirement information to the electrical signal;

analyzing means to receive and analyze the electrical signal to derive blast requirement information from the analyzed signal and connected to the solenoid means to control the operation thereof in accordance with the derived information; and cable means connected to the signal generating means and to the analyzing means to carry the electrical signal from the signal generating means to the analyzing means.

2. The system of claim 1 in which the electrical signal comprises a plurality of oscillations of different frequencies.

3. The system of claim 1 in which the connection means comprises a main valve comprising:

inner means movable between a closed position in which the blasting agent is prevented from reaching the channel means and a second position in which the blasting agent is able to pass through the main valve to the channel means, the inner means being connected to the solenoid means to be moved thereby either from the closed position to the second position or from the second position to the closed position in accordance with the information from the analyzed signal; and adjustment means connected to the inner means to adjust the second position to control the rate at which the blasting agent can pass through the valve means, the adjustment means being connected to the analyzing means to be controlled by information derived from the electrical signal.

4. The system of claim 3 in which the adjustment means comprises an electric motor and means to measure the operating current thereof and to interrupt the operating current only if the operating current exceeds a predetermined level while the adjustment means is trying to move the second position closer to the first position.

5. The system of claim 1 in which the cable means comprises a first end connected to the power supply means and to the analyzing means to supply operating current to the analyzing means and a second end connected to the signal generating means, whereby the cable means carries operating current to the signal generating means, the electrical signal being superimposed on the operating current carried to the signal generating means.

6. The system of claim 5 in which:

the signal generating means comprises means to generate a blasting signal, the system further comprising a dead man switch located at the nozzle end of the hose and electrically connected to the signal generating means to generate the blasting signal while the operator applies pressure to the dead man switch and to stop generating the blasting signal when pressure is removed from the dead man switch; and the analyzing means comprises means to detect the blasting signal and to actuate the solenoid means to stop the passage of blasting agent through the hose upon detection of the absence of the blasting signal.

7. The system of claim 6 in which:

the signal generating means comprises load means drawing at least a predetermined amount of the operating current carried thereto; and the analyzing means comprises means to measure the current carried to the signal generating means and to stop the passage of the blast agent through the hose if the current carried to the signal generating means drops to zero.

8. The system of claim 7 further comprising warning means connected to the analyzing means to be actuated thereby if the current carried to the signal generating means drops below the predetermined amount.

9. The system of claim 5 in which the means to measure the current to the signal generating means comprises means to reset operation of the signal generating means.

10. The system of claim 5 in which the analyzing means comprises detection means to detect a short-circuit condition of the cable means and to control the solenoid means to stop the flow of the blast agent through the hose upon such detection of a short-circuit condition.

11. The system of claim 1 comprising:

first solenoid-controlled means connected to the pressurizing means to control the supply of the carrier stream to the channel means to carry the blast agent through the hose means; and second solenoid-controlled means connected to the connection means to control the passage of the blast agent into the channel means.

12. The system of claim 11 in which:

the first solenoid-controlled means comprises a carrier stream supply valve connected to the channel means to control the flow of the carrier stream into the channel means; and the second solenoid-controlled means comprises a blast agent supply valve to control the passage of blast agent into the carrier stream.

13. A blasting system comprising:

a blast agent container having a blast agent outlet;

means to pressurize the container;

channel means comprising an input end, a blast agent port, and a flexible hose portion having a nozzle end;

pressurizing means connected to the input end to supply a carrier stream under pressure to the channel means;

carrier stream control valve means connected to the channel means to control the flow of the carrier stream through the channel means;

connection means connecting the blast agent outlet of the container to the blast agent port of the channel means to allow the blast agent entering the channel means to become entrained in the carrier stream;

blast agent supply valve means connected to the connection means to control the passage of the blast agent into the carrier stream in the channel means;

first solenoid means connected to the carrier stream control valve means to control the operation thereof;

second solenoid means connected to the blast agent supply valve means to control the operation thereof;

electrical power supply means;

electrical signal generating means located at the nozzle end and comprising controls to control the signal generating means to generate multi-frequency signals to impart blast requirement information to the electrical signal;

analyzing means to receive and analyze the electrical signals;

cable means extending along the hose and connected to the analyzing means to carry operating current thereto and connected to the signal generating means to carry operating current thereto and to carry the electrical signals from the signal generating means to the analyzing means to derive blast requirement information from the analyzed signal; and connection means connecting the analyzing means to the solenoid means to control the operation of the respective valve means in accordance with the derived information.

* * * * *